US006367666B1

(12) United States Patent
Hou et al.

(10) Patent No.: US 6,367,666 B1
(45) Date of Patent: Apr. 9, 2002

(54) INK CONTAINER WITH FIXED PRESSURE MODULATING MECHANISM

(75) Inventors: I-Chung Hou, Hsin-Chu; Cheng-Wei Hsu, Yung-Kang; Yuan-Liang Lan, Chu-Pei, all of (TW)

(73) Assignee: International United Technology Co., Ltd., Chu-Pei (TW)

( * ) Notice: Subject to any disclaimer, the term of this patent is extended or adjusted under 35 U.S.C. 154(b) by 0 days.

(21) Appl. No.: 09/851,582

(22) Filed: May 10, 2001

(30) Foreign Application Priority Data

Dec. 1, 2000 (TW) ..... 89125541 A

(51) Int. Cl.[7] ..... B67D 5/42
(52) U.S. Cl. ..... 222/386.5; 222/103; 347/86
(58) Field of Search ..... 222/386.5, 105, 222/103, 212; 347/86, 87, 85

(56) References Cited

U.S. PATENT DOCUMENTS 3,902,635 A * 9/1975 Jinotti ..... 222/103
4,228,925 A * 10/1980 Mendelovich ..... 222/103
4,991,742 A * 2/1991 Chang ..... 222/95
5,242,084 A * 9/1993 Jinotti ..... 222/103
5,363,130 A * 11/1994 Cowger et al. ..... 347/92
5,409,134 A * 4/1995 Cowger et al. ..... 222/1
5,505,339 A * 4/1996 Cowger et al. ..... 222/105
5,898,451 A * 4/1999 Kaplinky et al. ..... 347/87
6,003,966 A * 12/1999 Ahn ..... 347/7
6,149,256 A * 11/2000 McIntyre et al. ..... 347/2
6,203,146 B1 * 3/2001 Pawlowski, Jr. et al. ..... 347/85
6,213,598 B1 * 4/2001 Hou et al. ..... 347/86
6,250,751 B1 * 6/2001 Whitney et al. ..... 347/87
6,257,714 B1 * 7/2001 Seccombe ..... 347/92
6,293,666 B1 * 9/2001 Mou et al. ..... 347/87

* cited by examiner

*Primary Examiner*—Kenneth Bomberg
*Assistant Examiner*—Frederick Nicolas
(74) *Attorney, Agent, or Firm*—Winston Hsu

(57) ABSTRACT

An ink container includes a casing and an ink reservoir. An air bag is set within the ink reservoir for pressure modulation, an air vent enabling air to enter or exit the air bag. The ink reservoir further includes a fixed piece, a helical spring and a restraining plate. The fixed piece has a first fixed surface fixed inside the casing and a second fixed surface. The helical spring has a first end connected to the second fixed surface and a second end. The restraining plate has a first surface connected to the second end of the helical spring and a second surface pressing on the air bag to clamp the air bag between the second surface of the restraining plate and the casing.

5 Claims, 4 Drawing Sheets

INK CONTAINER WITH FIXED PRESSURE MODULATING MECHANISM

BACKGROUND OF THE INVENTION

1. Field of the Invention

The present invention relates to an ink container, and more particularly, to an easily fabricated ink container with a fixed piece, fixed pressure modulating mechanism.

2. Description of the Prior Art

The prior art ink container uses a flat spring within an air bag as a pressure modulating mechanism, as disclosed in U.S. Pat. No. 5,409,134. The flat spring must be installed within the air bag, so that the air bag has a somewhat complicated structure. This results in the wasting of much time when fabricating the ink container.

SUMMARY OF THE INVENTION

It is therefore a primary objective of the present invention to provide an ink container with a pressure modulating mechanism that is easy to fabricate, and that keeps pressure within the ink container lower than pressure of external air.

According to the claimed invention, the ink container comprises a casing and an ink reservoir. An air bag is set within the ink reservoir for pressure modulation, an air vent enabling air to enter or exit the air bag. The ink reservoir further includes a fixed piece, a helical spring and a restraining plate. The fixed piece has a first fixed surface fixed inside the casing and a second fixed surface. The helical spring has a first end connected to the second fixed surface and a second end. The restraining plate has a first surface connected to the second end of the helical spring and a second surface pressing on the air bag to clamp the air bag between the second surface of the restraining plate and the casing. Ink within the ink container flowing out of the ink outlet causes pressure within the ink container to drop. The air bag expands by accepting external air through the air vent, and the helical spring presses on the air bag by way of the restraining plate to keep the pressure within the ink container lower than the pressure of external air.

It is an advantage of the present invention that it is easily fabricated and retains precision of operation of the pressure modulating mechanism. Furthermore, the present invention reduces production costs and retains quality printing.

These and other objectives and advantages of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 1:
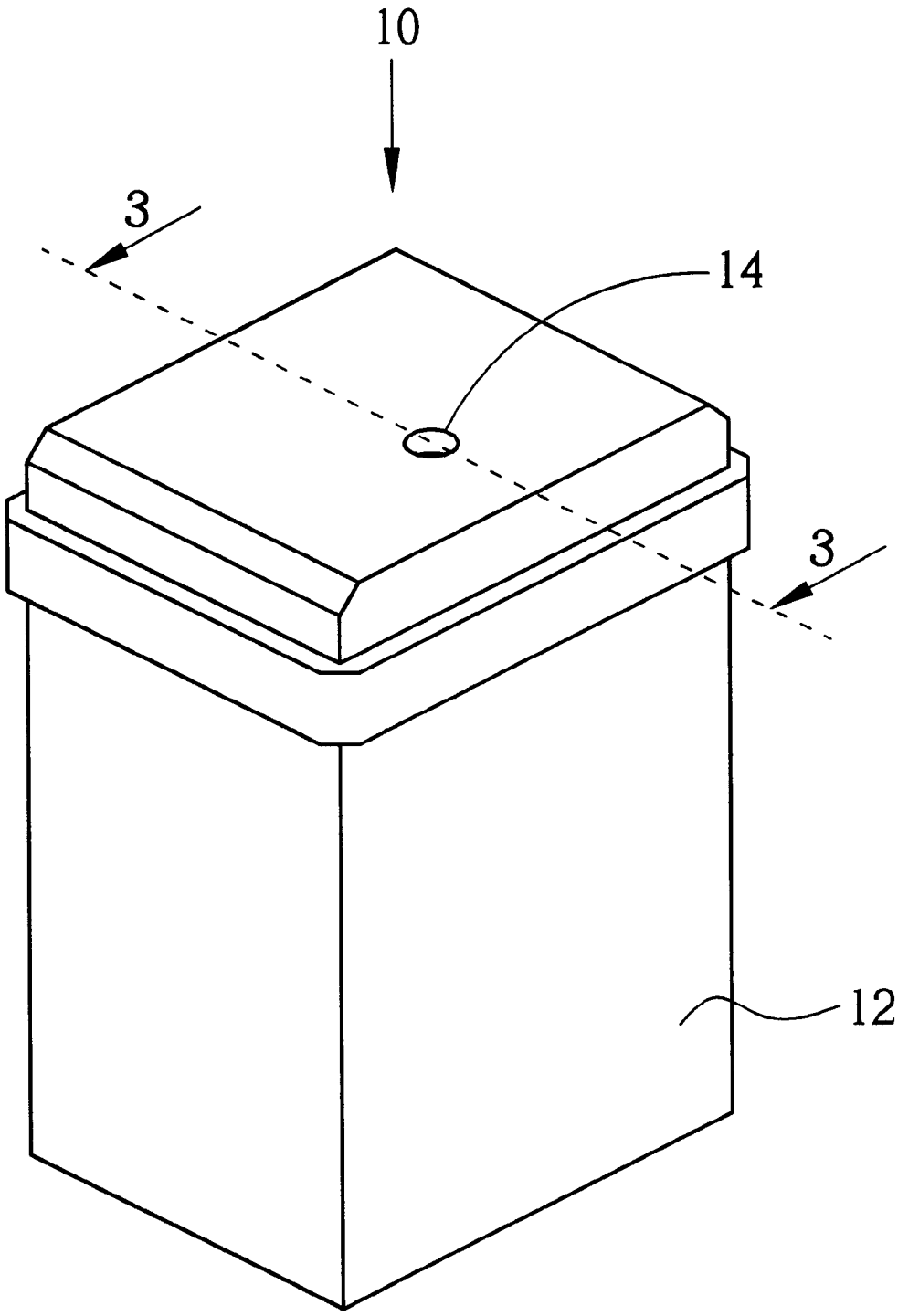
FIG. 1 is a perspective view of a present invention ink container.
Figure 2:
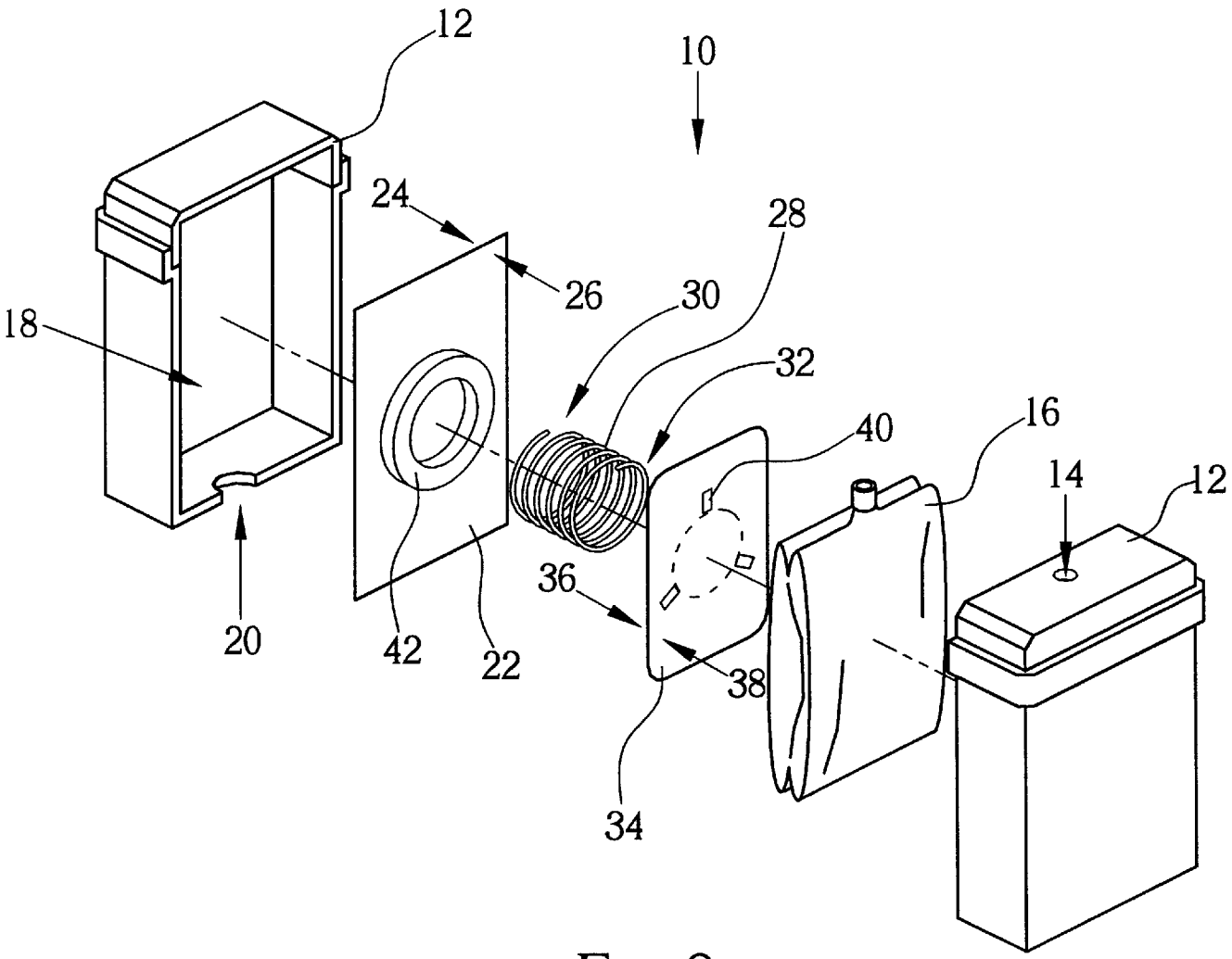
FIG. 2 is an exploded diagram of the ink container of FIG. 1.
Figure 3:
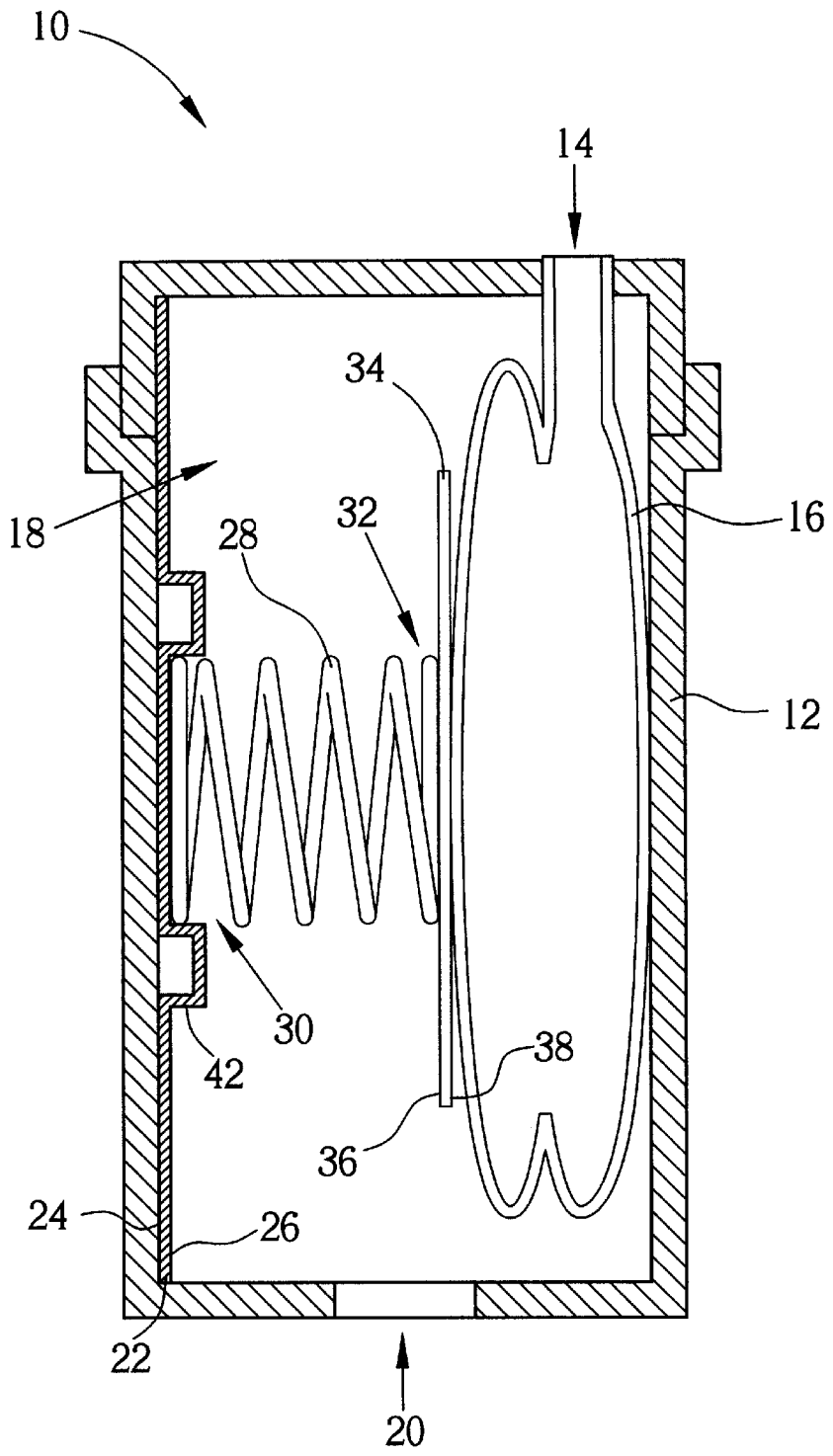
FIG. 3 is a sectional view of the ink container shown in FIG. 1.

Please refer to FIG. 1, FIG. 2 and FIG. 3. FIG. 1 is a perspective view of a present invention ink container 10, FIG. 2 is an exploded diagram of the ink container 10 and FIG. 3 is a sectional view of the ink container 10. The ink container 10 of the present invention comprises a casing 12 having an ink reservoir 18. The ink reservoir 18 is used to store ink. The casing 12 has an air vent 14 in a top portion of the casing 12 and an ink outlet 20 in a bottom portion of the casing.

The pressure modulating mechanism of the ink container 10 comprises a fixed piece 22, a helical spring 28, a restraining plate 34 and an air bag 16. A first fixed surface 24 of the fixed piece 22 connects to the inside of the ink reservoir 18. A second surface 26 of the fixed piece 22 comprises a fixed base 42, the shape of the fixed base 42 corresponding to a cross section of a first end 30 of the helical spring 28. The first end 30 of the helical spring 28 is connected to the fixed piece 22 at the fixed base 42 of the fixed piece 22.

A second end 32 of the helical spring 28 is fixed on the first surface 36 of the restraining plate 34 by a hook-like structure 40. A second surface 38 of the restraining plate 34 presses on the air bag 16 to clamp the air bag 16 between the second surface 38 of the restraining plate 34 and the inner portion of the ink reservoir 18. The air bag 16 is isolated from ink within the inner portion of the ink reservoir 18. Air enters and exits the air bag 16 through the air vent 14.

Please further refer to FIG. 2 and FIG. 3 for operation of the pressure modulating mechanism. The shape of the fixed piece 22 corresponds to the shape of the inner portion of the ink reservoir 18 so that the first fixed surface 24 of the fixed piece 22 coincides with the inner portion of the ink reservoir 18. The second fixed surface 26 of the fixed piece 22 has a fixed base 42 monolithically formed with the fixed piece 22. The shape of a sunken portion of the fixed base 42 corresponds to a cross section of the first end 30 of the helical spring 28 so that the first end 30 of the helical spring 28 is fixable at the fixed base 42. The second end 32 of the helical spring 28 is securely fixed with the restraining plate 34 by connecting the second end 32 of the helical spring 28 to the hook-like structure 40 of the first surface 36 of the restraining plate 34. The helical spring 28 produces ideal pressure to clamp the air bag 16 between the second surface 38 of the restraining plate 34 and the inner portion of the ink reservoir 18. Because of the elastic force of the helical spring 28, the restraining plate 34 provides appropriate pressure to the air bag 16 to keep the pressure within the ink reservoir 18 lower than external air pressure. By being shaped to correspond to the inside of the casing 12, the fixed piece 22 also connects, without sliding, to the inner portion of the ink reservoir 18. The first end 30 of the helical spring 28 will not slide once attached to the fixed base 42 of the fixed piece 22. While the position of the first end 30 is fixed, the second end 32 of the helical spring 28 can provide proper force to the restraining plate 34 in an exact direction and at an exact position. Dispersed over an area of the restraining plate 34, the correct force can apply uniform pressure to press the air bag 16 towards the inner portion of the ink reservoir 18. This controls the volume of the air bag 16 and further keeps the pressure within the ink reservoir 18 lower than external air pressure.

Please refer again to FIG. 3 for explanation of the operational principle of the pressure modulating mechanism. Ink within the ink reservoir 18 flows out of the ink outlet 20, feeding a printer. This outflow of ink causes pressure within the ink reservoir 18 to drop. In response, the air bag 16 expands by accepting external air through the air vent 14. If the air bag 16 expanded at will, the pressure within the ink reservoir 18 would equalize with that of external air. The ink reservoir 18, therefore, would not keep the pressure within the ink reservoir 18 lower than external air pressure, and ink within the ink reservoir 18 would thus flow out of the ink outlet 20 uncontrollably. To keep the pressure within the ink reservoir 18 lower than external air pressure, expansion of the volume of the air bag 16 needs to be restrained appropriately. So, the ink container 10 of this invention uses the helical spring 28 to press upon the air bag 16. The helical spring 28 pressing the air bag 16 by way of the restraining plate 34 restrains expansion of the air bag 16. The pressure within the ink reservoir 18 is thus continuously kept less than external air pressure.

Figure 4:
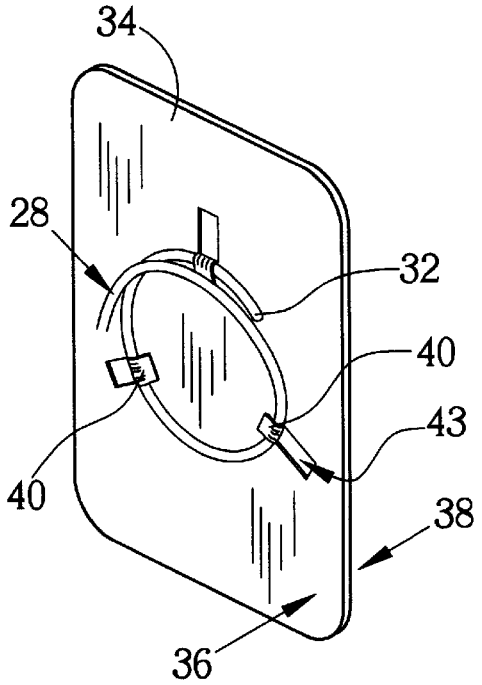
FIG. 4 is a diagram of a present invention ink container with a helical spring fixed to a restraining plate.

Please refer to FIG. 4. FIG. 4 is a diagram of the ink container 10 with the second end 32 of the helical spring 28 attached to the first surface 36 of the restraining plate 34. In this first embodiment, the restraining plate 34 is a thin plate. The hook-like structure 40 comprises strips dug out from the restraining plate 34 (remaining cavities 43) and bent inside to securely hold the second end 32 of the helical spring.

Figure 5:
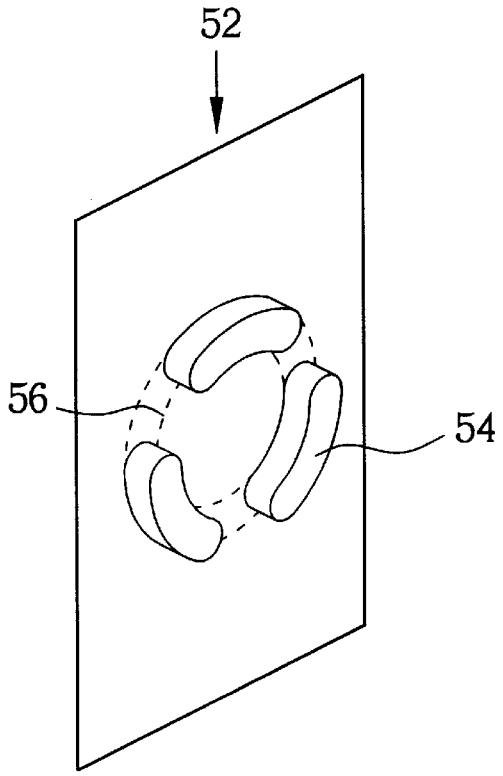
FIG. 5 is a perspective view of a second preferred embodiment of a fixed piece.

Please refer to FIG. 5. FIG. 5 is a perspective view of a second embodiment of the fixed piece 22 from FIG. 1. The fixed base 54 of the fixed piece 52 is used to fix the first end 30 of the helical spring 28. The fixed base 54 comprises three protruding blocks. The area 56 surrounded by the three protruding blocks is shaped so that the first end 30 of the helical spring 28 exactly. fits within the fixed base 54. As with the fixed piece 22, the shape of the fixed piece 52 is the same as the shape of the inner portion of the ink reservoir 18. The fixed piece 52 is fixed, without slippage, to the inner portion of the ink reservoir 18 by the elastic force of the helical spring 28. No other processes need be employed to fix the fixed piece 52 to the inner portion of the ink reservoir 18.

In general, this invention provides an ink container with a pressure modulating mechanism that is easy to fabricate. The components within the pressure modulating mechanism of the ink container correspond to the shape of the casing. Because of the elastic force produced by the helical spring at both ends of the helical spring, the present invention does not need complicated fixing methods and fabricating processes to fabricate components within the ink container or to keep the pressure modulating mechanism operating properly. This not only reduces the cost of production but also retains the quality of printing.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink container comprising:

a casing;

an air vent set in a top portion of the casing;

an air bag set within the casing, the air vent enabling air to enter or exit the air bag;

an ink reservoir disposed between the air bag and the casing, the ink reservoir storing ink;

an ink outlet set in a bottom portion of the casing, the ink outlet connected to the ink reservoir;

a fixed piece comprising a first fixed surface fixed inside the casing and a second fixed surface;

a helical spring comprising a first end connected to the second fixed surface and a second end; and a restraining plate with a first surface connected to the second end of the helical spring and a second surface pressing on the air bag to clamp the air bag between the second surface of the restraining plate and the casing;

wherein ink within the ink container flowing out of the ink outlet causes pressure within the ink container to drop, the air bag expands by accepting external air through the air vent, and the helical spring presses on the air bag by way of the restraining plate to keep the pressure within the ink container lower than a pressure of the external air.

2. The ink container of claim 1 wherein the first surface of the restraining plate further comprises a hook-like structure that enables the second end of the helical spring to be fixed on the first surface.

3. The ink container of claim 2 wherein the fixed piece has a shape that corresponds to a shape of the ink container so that the fixed piece is connectable to a side of the ink container.

4. The ink container of claim 3 wherein the fixed piece further comprises a fixed base set on the second fixed surface of the fixed piece, the shape of the fixed base corresponding to a cross section of the first end of the helical spring so that the helical spring is fixable on the fixed piece by connecting the helical spring to the fixed base.

5. The ink container of claim 4 wherein the fixed piece is monolithically formed with the fixed base.

* * * * *